US006253736B1

(12) United States Patent
Crofts et al.

(10) Patent No.: US 6,253,736 B1
(45) Date of Patent: Jul. 3, 2001

(54) FUEL INJECTOR NOZZLE ASSEMBLY WITH FEEDBACK CONTROL

(75) Inventors: John D. Crofts, Edinburgh; Mark S. Cavanagh; Howard S. Savage, both of Columbus, all of IN (US)

(73) Assignee: Cummins Engine Company, Inc., Columbus, IN (US)

( * ) Notice: Subject to any disclaimer, the term of this patent is extended or adjusted under 35 U.S.C. 154(b) by 0 days.

(21) Appl. No.: 09/371,273

(22) Filed: Aug. 10, 1999

(51) Int. Cl.[7] ..... F02M 37/04

(52) U.S. Cl. ..... 123/498; 123/467

(58) Field of Search ..... 123/467, 498, 123/357, 506, 458; 239/585.1, 533.1, 533.9, 585.2

(56) References Cited

U.S. PATENT DOCUMENTS

| | | | | |
|---|---|---|---|---|
| 4,649,886 | * | 3/1987 | Igashira et al. | 123/498 |
| 4,966,119 | | 10/1990 | Mitsuyasu et al. | 123/498 |
| 5,053,668 | | 10/1991 | Mitsuyasu | 310/317 |
| 5,057,734 | | 10/1991 | Tsuzuki et al. | 310/317 |
| 5,477,834 | * | 12/1995 | Yoshizu | 123/501 |
| 5,479,902 | | 1/1996 | Wirbeleit et al. | 123/498 |
| 5,605,134 | | 2/1997 | Martin | 123/467 |
| 5,711,277 | | 1/1998 | Fuseya | 123/496 |
| 5,713,326 | | 2/1998 | Huber | 123/299 |
| 5,779,149 | | 7/1998 | Hayes, Jr. | 123/467 |
| 5,803,361 | | 9/1998 | Horiuchi et al. | 239/88 |
| 5,819,704 | | 10/1998 | Tarr et al. | 123/467 |
| 5,819,710 | | 10/1998 | Huber | 123/467 |
| 5,860,597 | | 1/1999 | Tarr | 239/124 |
| 5,884,848 | | 3/1999 | Crofts et al. | 239/533.2 |

* cited by examiner

*Primary Examiner*—Henry C. Yuen
*Assistant Examiner*—Mahmoud Gimie
(74) *Attorney, Agent, or Firm*—Nixon Peabody LLP; Charles M. Leedom Jr.; Tim L. Brackett, Jr.

(57) ABSTRACT

An injector is provided which includes a nozzle valve element, a control volume, and an injection control valve for controlling fuel flow from the control volume so as to control nozzle valve movement. Importantly, the injector includes a nozzle valve lift detecting device for detecting nozzle valve lift and providing a nozzle valve element lift feedback signal. In addition, an injection control valve member movement detecting device may be provided for detecting movement of the injection control valve member into open and/or closed positions and generating a control valve member position feedback signal. One or both of the feedback signals may be used for adjusting the timing and/or rate of opening of the injection control valve thereby controlling the timing and/or rate of opening of the nozzle valve element to control the timing and/or rate of fuel injection of subsequent injection events. The nozzle valve element lift detecting device includes positioning the injection control valve for contact by the nozzle valve element and a piezoelectric element for generating the feedback signal. A control device is used to process the feedback signal and adjust control of the injection control valve to achieve reduced emissions.

22 Claims, 4 Drawing Sheets

FUEL INJECTOR NOZZLE ASSEMBLY WITH FEEDBACK CONTROL

TECHNICAL FIELD

The invention relates to an improved nozzle assembly for fuel injectors which effectively controls fuel metering.

BACKGROUND OF THE INVENTION

In most fuel supply systems applicable to internal combustion engines, fuel injectors are used to direct fuel pulses into the engine combustion chamber. A commonly used injector is a closed-nozzle injector which includes a nozzle assembly having a spring-biased nozzle valve element positioned adjacent the nozzle orifice for resisting blow back of exhaust gas into the pumping or metering chamber of the injector while allowing fuel to be injected into the cylinder. The nozzle valve element also functions to provide a deliberate, abrupt end to fuel injection thereby preventing a secondary injection which causes unburned hydrocarbons in the exhaust. The nozzle valve is positioned in a nozzle cavity and biased by a nozzle spring to block fuel flow through the nozzle orifices. In many fuel systems, when the pressure of the fuel within the nozzle cavity exceeds the biasing force of the nozzle spring, the nozzle valve element moves outwardly to allow fuel to pass through the nozzle orifices, thus marking the beginning of injection. In another type of system, such as disclosed in U.S. Pat. No. 5,819,704, the beginning of injection is controlled by a servo-controlled needle valve element. The assembly includes a control volume positioned adjacent an outer end of the needle valve element, a drain circuit for draining fuel from the control volume to a low pressure drain, and an injection control valve positioned along the drain circuit for controlling the flow of fuel through the drain circuit so as to cause the movement of the needle valve element between open and closed positions. Opening of the injection control valve causes a reduction in the fuel pressure in the control volume resulting in a pressure differential which forces the needle valve open, and closing of the injection control valve causes an increase in the control volume pressure and closing of the needle valve.

Internal combustion engine designers have increasingly come to realize that substantially improved fuel supply systems are required in order to meet the ever increasing governmental and regulatory requirements of emissions abatement and increased fuel economy. Specifically, it is well known that improved control of fuel metering, i.e. the rate of fuel flow into the combustion chamber, is essential in reducing the level of emissions generated by the diesel fuel combustion process while minimizing fuel consumption. As a result, many proposals have been made to provide metering, or injection rate, control devices in closed nozzle fuel injector systems. U.S. Pat. No. 5,779,149 to Hayes, Jr. discloses a piezoelectric controlled common rail injector of the servo-controlled type. The piezoelectric actuator controls the movement of an inwardly opening poppet-type control valve for controlling the flow of fuel from a control volume and ultimately the movement of the nozzle valve element. Fuel metering is variably controlled by controlling the duration and modulation of the electrical signal provided to the actuator. U.S. Pat. No. 5,713,326 to Huber discloses a similar injector design. Although these systems provide some control over fuel metering, nozzle valve opening and closing characteristics are sensitive to injection pressure, component tolerances and wear, fuel properties and temperature. Therefore, additional fuel metering control is desirable.

U.S. Pat. No. 5,860,597 to Tarr discloses a servo-controlled nozzle assembly for a fuel injector which operates to effectively control and vary the rate of fuel injection. The assembly includes a control valve element positioned in a control volume for cooperating with the needle valve element to control the drain flow of fuel through the drain circuit. Specifically, positioning of the control valve element relative to the valve surface controls drain flow through the drain circuit. A fast proportional actuator is used to permit selective controlled movement of the control valve element in proportion to the magnitude of the input signal to the actuator. However, this design does not offer any feedback information on actual valve lift which can be used for metering control. In addition, the control valve element engages a valve seat formed on the movable needle valve element and therefore may provide sufficient sealing in all situations as compared to a stationary valve seat.

Therefore, there is a need for a simple nozzle assembly for a fuel injector which is capable of effectively controlling fuel metering and providing variable control of the rate of fuel injection by sensing needle valve lift.

SUMMARY OF THE INVENTION

It is, therefore, one object of the present invention to overcome the deficiencies of the prior art and to provide a fuel injector nozzle assembly which better enables the engine to meet future diesel engine exhaust emission requirements while minimizing fuel consumption.

Another object of the present invention is to provide a fuel injector having improved control of fuel metering and rate shaping.

Yet another object of the present invention is to provide a fuel injector which permits the nozzle valve opening and closing characteristics to be more easily tailored as desired.

Still another object of the present invention is to provide a fuel injector having a nozzle assembly capable of compensating for changes in injection pressure, component tolerances and wear, fuel properties, temperature and other "noises" which alter the lift characteristics of the nozzle valve.

It is yet another object of the present invention to provide a fuel injector having a nozzle assembly capable of sensing nozzle valve lift to provide a feedback signal to enhance fuel metering control.

Yet another object of the present invention is to provide a fuel injector having a control valve and a system capable of detecting, and providing feedback signals relating to, control valve opening and closing.

A still further object of the present invention is to provide a fuel injector which is capable of accurately and variably controlling the timing of nozzle valve opening and closing, the length of the injection event and the rate at which the nozzle valve opens to provide optimum control over fuel injection metering and rate shaping.

These and other objects are achieved by providing a closed nozzle injector for injecting fuel at high pressure into the combustion chamber of an engine, comprising an injector body containing an injector cavity and an injector orifice communicating with one end of the injector cavity to discharge fuel into the combustion chamber and a nozzle valve element positioned in one end of the injector cavity adjacent the injector orifice. The nozzle valve element is movable between an open position in which fuel may flow through the injector orifice into the combustion chamber and a closed position in which fuel flow through the injector orifice is blocked. The injector also includes a control volume position to receive a pressurized supply of fuel and a drain circuit for draining fuel from the control volume to a low pressure drain. Also, an injection control valve is positioned along the drain circuit to control fuel flow from the control volume. The injector also includes a nozzle valve element lift detecting device for detecting movement of the nozzle valve element into the open position and for providing a nozzle valve element lift feedback signal. The nozzle valve element lift detecting device may include a piezoelectric element. The injection control valve may include a reciprocally mounted control valve member and a piezoelectric actuator connected to the control valve member. Therefore, the piezoelectric element used to detect nozzle valve movement may be separate from the piezoelectric actuator or integrated therein. The control valve member is preferably movable toward an outer end of the nozzle valve element into an open position and away from the nozzle valve element into a closed position. The nozzle valve element lift detecting device includes positioning the control valve member for contact by the nozzle valve element when the nozzle valve element is in the open position. Preferably, the control valve member is of the poppet valve type and the nozzle valve element is a single piece structure.

The closed nozzle injector may also include a control means for receiving the nozzle valve element lift feedback signal and generating an injection control signal based on the nozzle valve element lift feedback signal. The control means varies the injection control signal based on the nozzle valve element lift feedback signal to vary at least one of a timing of an opening of the injection control valve and a rate of opening of the injection control valve. The control means also permits the detection of the opening or unseating, and the closing or reseating, of the control valve member and thus provides additional feedback for improved control.

DETAILED DESCRIPTION OF THE INVENTION

Throughout this application, the words "inward", "innermost", "outward" and "outermost" will correspond to the directions, respectively, toward and away from the point at which fuel from an injector is actually injected into the combustion chamber of an engine. The words "upper" and "lower" will refer to the portions of the injector assembly which are, respectively, farthest away and closest to the engine cylinder when the injector is operably mounted on the engine.

Figure 1:
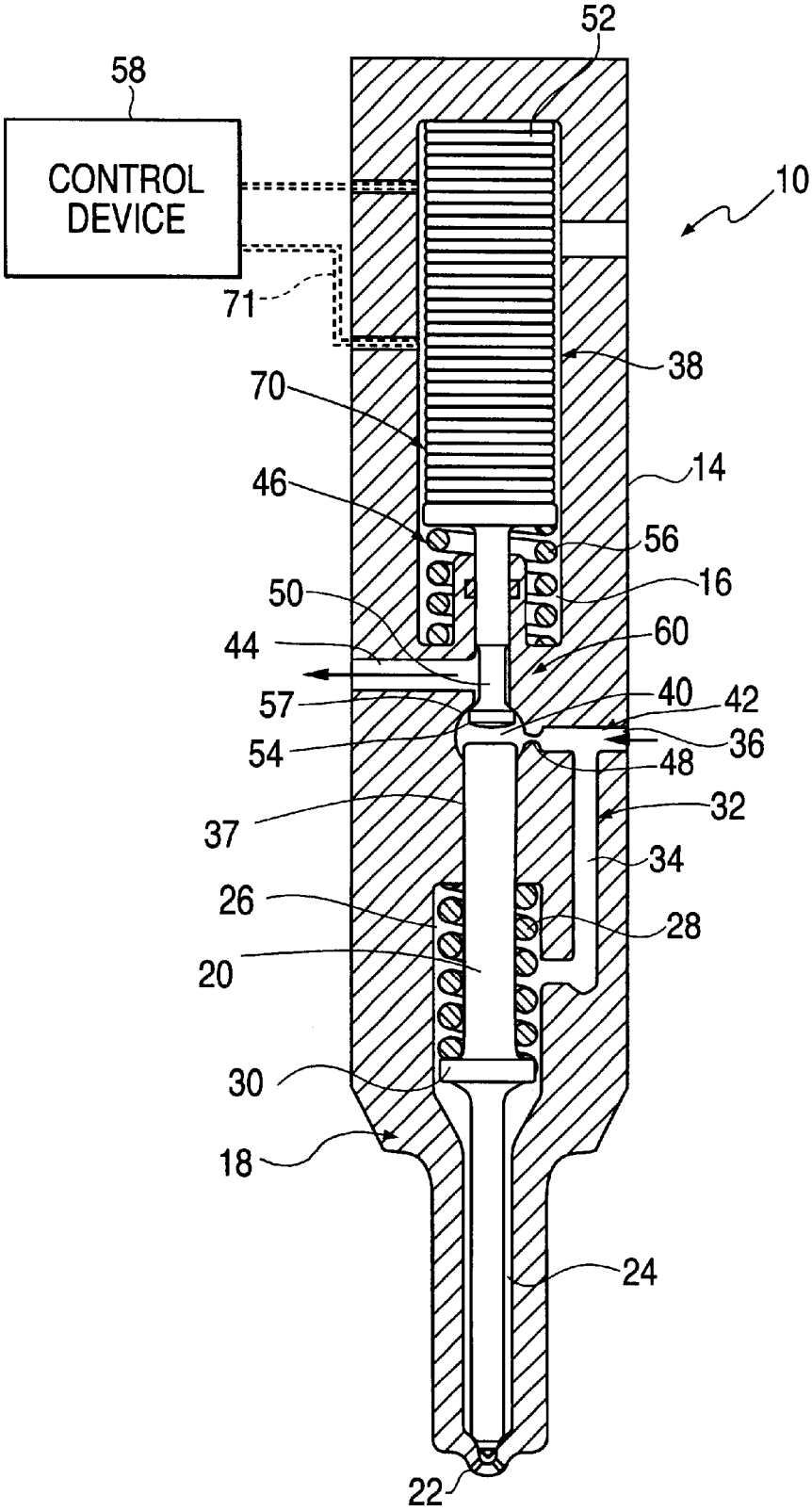
FIG. 1 is a cross sectional view of the closed nozzle fuel injector of the present invention.

Referring to FIG. 1, there is shown a closed nozzle fuel injector of the present invention, indicated generally at 10, which functions to effectively permit accurate and variable control of fuel metering while providing injection rate shaping. Fuel injector 10 is comprised of an injector body 14 having a generally elongated, cylindrical shape which forms an injector cavity 16. The lower portion of fuel injector body 14 includes a closed nozzle assembly, indicated generally at 18, which includes a nozzle valve element 20 reciprocally mounted for opening and closing injector orifices 22 formed in body 14 thereby controlling the flow of injection fuel into an engine combustion chamber (not shown).

Nozzle valve element 20 is preferably formed from a single integral piece structure and positioned in a nozzle cavity 24 and spring cavity 26. Spring cavity 26 contains a bias spring 28 for abutment against a land 30 formed on nozzle valve element 20 so as to bias nozzle valve element 20 into a closed position as shown in FIG. 1. A fuel transfer circuit 32, including a high pressure supply passage 34, is formed in injector body 14 for supplying high pressure fuel from an inlet 36 to nozzle cavity 24 via spring cavity 26. The upper end of nozzle valve element 20 is positioned for slidable movement within a bore 37 sized to create a fluidic seal between the surfaces.

Fuel injector 10 further includes a nozzle valve control arrangement indicated generally at 38 for controlling the movement of nozzle valve element 20 between open and closed positions so as to define an injection event during which fuel flows through injector orifices 22 into the combustion chamber. Specifically, nozzle valve control arrangement 38 operates to initiate the beginning of movement of nozzle valve element 20 from one of its positions to the other while also variably controlling the movement, i.e. rate of movement of nozzle valve element 20 as it moves between open and closed positions and the degree of opening of the nozzle valve element. In this manner, nozzle valve control arrangement 38 functions to control the quantity of fuel metered and also as a rate shaping control device for producing a predetermined time varying change in the flow rate of fuel injected into the combustion chamber during an injection event so as to improve combustion and minimize emissions.

The nozzle assembly of the present invention can be adapted for use with a variety of injectors and fuel systems. For example, closed nozzle injector 10 may receive high pressure fuel from a high pressure common rail or alternatively, a pump-line-nozzle system or a unit injector system incorporating, for example, a mechanically actuated plunger into the injector body. Thus, the nozzle assembly of the present invention may be incorporated into any fuel injector or fuel system which supplies high pressure fuel to fuel transfer circuit 32 while permitting nozzle valve control arrangement 38 to control the timing, quantity and rate shape of the fuel injected into the combustion chamber.

Nozzle valve control arrangement 38 includes a control volume or cavity 40 formed in injector body 14 at the outer end of bore 37 for receiving an outer end of nozzle valve element 20 and a control volume charge circuit 42 for directing fuel from inlet 36 into control volume 40. Nozzle valve control arrangement 38 further includes a drain circuit 44 formed in injector body 14 for draining fuel from control volume 40 and an injection control valve 46 positioned along drain circuit 44 for variably controlling the flow of fuel through drain circuit 44 so as to cause controlled, predetermined movement of nozzle valve element 20. Control volume charge circuit 42 includes an orifice 48 designed with a smaller cross sectional flow area than drain circuit 44 to cause a greater amount of fuel to be drained from control volume 40 than is replenished via control volume charge circuit 42 upon opening of injection control valve 46 as discussed hereinbelow. Injection control valve 46 is specifically designed to enable precise control over the movement of nozzle valve element 20 from its closed to its open position so as to predictably control the flow of fuel through injector orifices 22 for achieving a desired fuel metering and injection rate shape.

As shown in FIG. 1, injection control valve 46 includes a control valve member 50 and an actuator 52 for selectively moving control valve member 50 through a predetermined variable lift schedule so as to precisely control the movement of nozzle valve element 20. Actuator 52 is positioned in the upper portion of injector cavity 16 and operatively connected to control valve member 50. Piezoelectric actuator 52 may comprise a columnar laminated body of thin disk-shaped elements each having a piezoelectric affect. When a voltage, i.e. +150 volts, is applied to each element, the element expands along the axial direction of the column. Conversely, when a voltage of −150 volts is applied to each element, the element contracts so that the inner end of piezoelectric actuator 52 moves away from closed nozzle assembly 18. Piezoelectric actuator 52 may include any type or design of piezoelectric actuator capable of actuating control valve member 50 as described hereinbelow. The expansion/contraction of piezoelectric actuator 52 is directly transmitted to control valve member 50 causing control valve member 50 to move between open and closed positions. Although actuator 52 is preferably of the piezoelectric type, any type of actuator assembly capable of selectively controlling the movement of control valve member 50 with a high degree of precision may be used. For example, a fast proportional actuator, such as an electromagnetic, or magnetostrictive could be used to move control valve member 50 in proportion to the magnitude of the input signal to the actuator, i.e. voltage, current, etc.

Control valve member 50 is connected to piezoelectric actuator 52 at one end and includes a valve head 54 positioned in control volume 40 at an opposite end. A bias spring 56 is used to bias control valve member 50 outwardly and thus valve head 54 into sealing engagement with a valve seat 57 formed on the inner surface of control volume 40. Actuation of piezoelectric actuator 52 causes expansion of the piezoelectric elements and movement of control valve member 50 toward nozzle assembly 18 and thus movement of valve head 54 inwardly and away from valve seat 57 resulting in the opening of control valve member 50. Thus, control valve member 50 is of the poppet-type having positive sealing engagement with valve seat 57 when in the closed position. The actuation and de-actuation of actuator 52 is controlled by a control device 58, i.e. an electronic control unit, which precisely controls both the timing of injection by providing an injection control signal to actuator 52 at a predetermined time during engine operation and the injection rate shape by controllably varying the voltage supplied to actuator 52 based on engine operating conditions.

Importantly, fuel injector 10 also includes a nozzle valve lift detecting device 60 for detecting the lift or extent of movement of nozzle valve element 20 into the open position and for providing a nozzle valve element lift feedback signal for enabling improved control over the movement of nozzle valve element 20. Specifically, nozzle valve lift detecting device 60 includes the relative positioning of control valve member 50 and the outer end of nozzle valve element 20 in such a manner that causes nozzle valve element 20 to contact valve head 54 of control valve member 50 during outward movement of nozzle valve element 20 into the open position. Specifically, nozzle valve element 20 is positioned to contact the inner end of valve head 54 of control valve member 50 to define an outermost open position of nozzle valve element 20 as clearly shown in FIG. 2*c*. When nozzle valve element 20 impacts control valve member 50, a slight axial force is transmitted to piezoelectric actuator 52 causing compression of the piezoelectric elements and generation of voltage. As shown in FIG. 3, the increase in voltage due to the impact force of nozzle valve element 20 on control valve member 50 causes a "spike" in the voltage curve. Thus, the increase in voltage functions as a nozzle valve element lift feedback signal which is detected by control device 58. Control device 58 may then process and utilize the nozzle valve element lift feedback signal in an appropriate manner to vary the timing of the injection control signal and/or the amount of voltage supplied to actuator 52 to thereby variably control the injection timing, fuel metering and/or injection rate shape. For example, if the opening response time of nozzle valve element 20 does not fall within predetermined limits, the voltage wave form applied to piezoelectric actuator 52 is adjusted by control device 58. Specifically, if the detected response time between actuation of actuator 52 and the impact of nozzle valve element 20 against control valve member 50 is less than a predetermined target value, the voltage applied to piezoelectric actuator 52 would be reduced for the next injection event. Likewise, if the detected response time is greater than a predetermined target value, the piezo voltage would be increased for the next injection event to thereby reduce the response time of the opening of nozzle valve element 20.

Figure 2A:
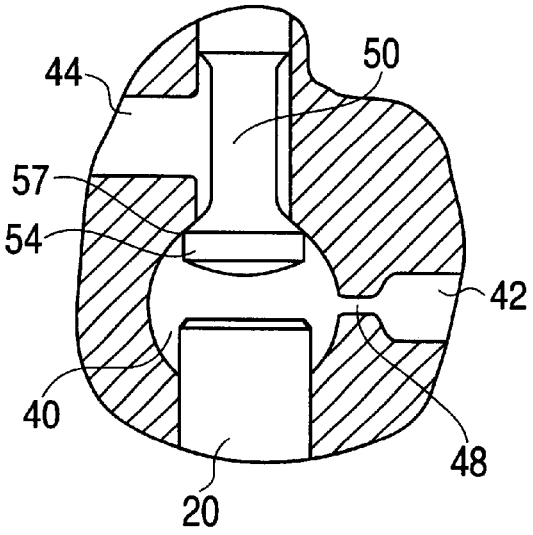
FIGS. 2*a*–2*d* are expanded cross sectional views of the portion of the fuel injector surrounding the control volume showing the control valve member and nozzle valve element at various positions.
Figure 2B:
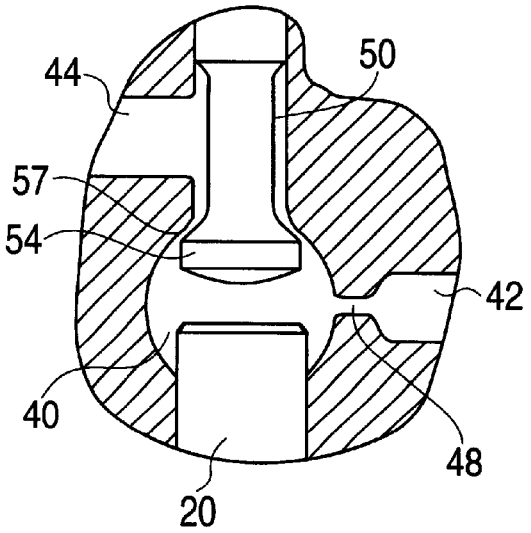
Figure 2C:
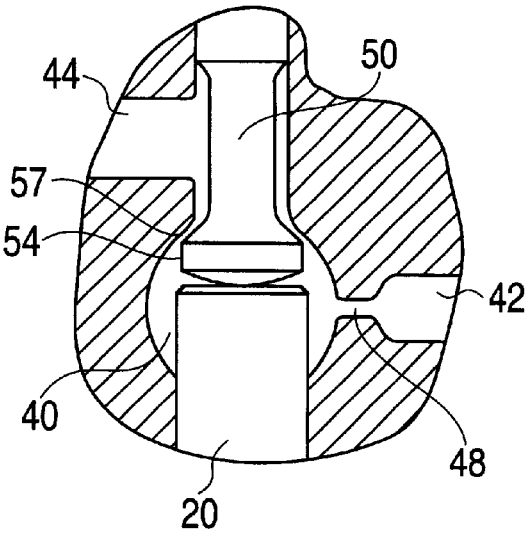
Figure 2D:
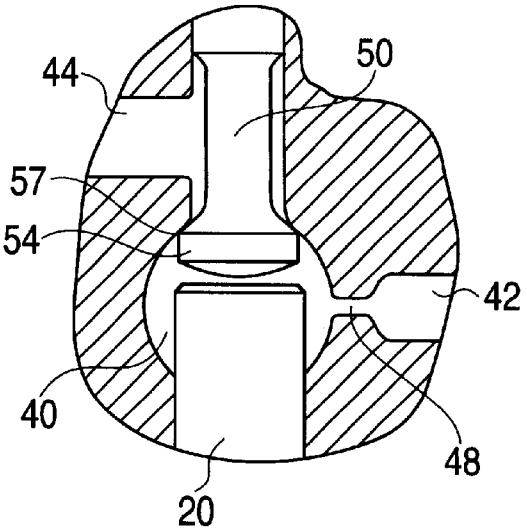
Figure 3:
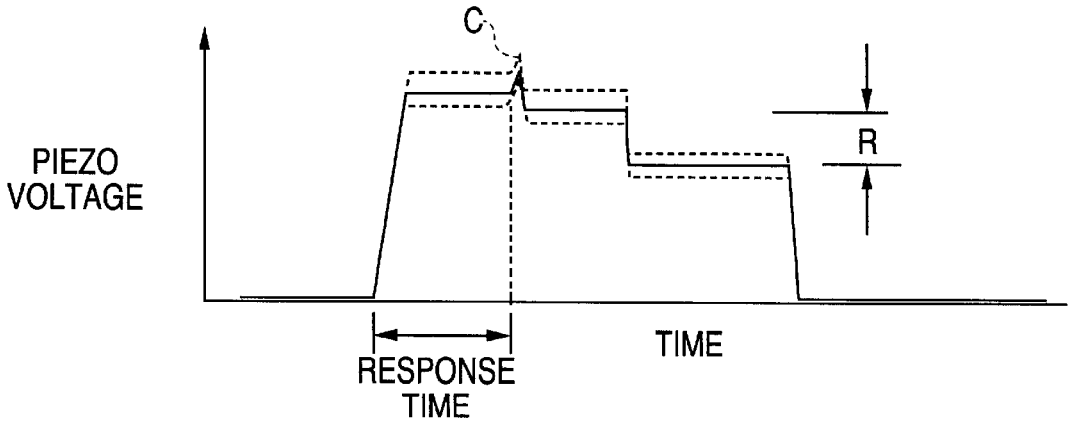
FIG. 3 is a graph illustrating piezo voltage versus time for a given injection event.
Figure 4:
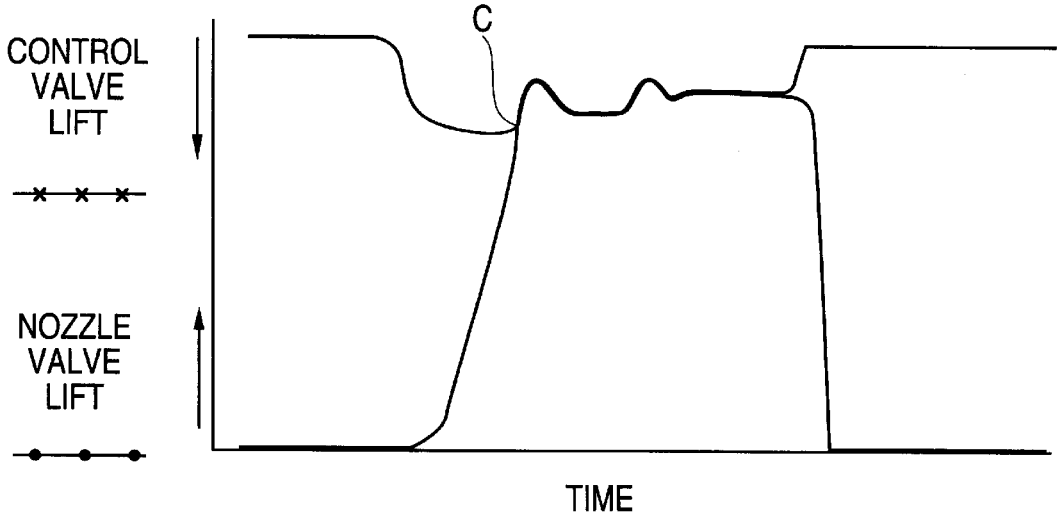
FIG. 4 is a graph of control valve lift and nozzle valve lift versus time for the same injection event illustrated in FIG. 3.

Referring to FIGS. 2*a*–2*d*, 3 and 4, during operation, prior to an injection event, injection control valve 46 is de-energized causing control valve member 50 to be biased by spring 56 into the closed position in sealing engagement against valve seat 57 (FIG. 2*a*). The fuel pressure level experienced in spring cavity 26 and nozzle cavity 24 is also present in control volume charge circuit 42 and control volume 40 since drain flow through drain circuit 44 is blocked by control valve member 50. As a result, the fuel pressure forces acting inwardly on nozzle valve element 20, in combination with the bias force of spring 28, maintain nozzle valve element 20 in its closed position blocking flow through injector orifices 22 as shown in FIG. 1. At a predetermined time during the supply of high pressure fuel to fuel transfer circuit 32, actuator 52 is energized to controllably move control valve member 50 from the position shown in FIG. 2*a* to an open position shown in FIG. 2*b*. The movement of control valve member 50 follows a predetermined lift schedule which varies the rate of movement of control valve member 50 so as to controllably vary the distance between control valve member 50 and valve seat 57 thus varying the drain flow from control volume 40 which ultimately permits precise control over the movement of nozzle valve element 20 between its closed and open positions. In one example, as shown in FIG. 3, the voltage applied to piezoelectric actuator 52 is rapidly increased to initiate the injection event. In response, as shown in FIG. 4, as control valve member 50 is lifted from valve seat 57, fuel flows from control volume 40 through drain circuit 44 to the low pressure drain. Simultaneously, high pressure fuel flows from control volume charge circuit 42 and orifice 48 into control volume 40. However, since orifice 48 is designed with a smaller cross sectional flow area than drain circuit 44, a greater amount of fuel is drained from control volume 40 than is replenished via control volume charge circuit 42. As a result, the pressure in control volume 40 immediately decreases. Fuel pressure forces acting on nozzle valve element 20 due to the high pressure fuel in nozzle cavity 24, begin to move nozzle valve element 20 outwardly against the bias force of spring 28 as shown in FIG. 2*b* and graphically represented in FIG. 4. Referring to FIG. 2*c*, nozzle valve element 20 will continue its outward movement and contact the inner end of valve head 54 to define the extreme open position or outermost position of nozzle valve element 20. Nozzle valve element 20 will then be maintained in abutment with control valve member 50 until an end of injection signal is forwarded from control device 58 to actuator 52 causing de-energization of actuator 52 (FIG. 3) and the movement of control valve member 50 outwardly to end the injection event as shown in FIG. 2*d* and graphically shown in FIG. 4.

Importantly, the present invention recognizes that the impact of nozzle valve element 20 against control valve member 50 can be monitored and detected for use in controllably varying the timing and rate shape of subsequent injection events to reduce emissions and minimize fuel consumption. In the preferred embodiment, the impact of nozzle valve element 20 against control valve member 50 is detected by monitoring a piezo voltage signal across a set of piezoelectric elements attached to control valve member 50. As shown in FIGS. 3 and 4, when nozzle valve element 20 impacts control valve member 50 as indicated at C, the element and member begin to move together while a voltage spike is created upon impact. The piezoelectric element providing the nozzle valve element lift feedback signal in the form of a voltage spike could be all or only a portion of the piezoelectric elements of actuator 52. Alternatively, a separate force transducer, such as a series of piezoelectric elements, could be incorporated into injector body 14 and electrically connected to control device 58 via connections 71. In both cases, the impact of nozzle valve element 20 against control valve member 50 creates a voltage signal which can be detected by control device 58. Control device 58 may then process the signal to determine whether the response time (FIG. 3) of the opening of nozzle valve element 20 falls within predetermined limits and adjust the voltage valve form applied to actuator 52 for subsequent injection events to the extent the response time is unacceptable. Increased and decreased voltages for subsequent injection events are represented by dashed lines in FIG. 3. Also, control device 58 may utilize the nozzle valve element lift feedback signal to monitor and adjust the timing of the initiation and termination of the injection event by adjusting the timing of energization and de-energization of actuator 52.

It should be noted that once nozzle valve element 20 begins to open, control valve member 50 may then be at least partially closed to limit the quantity of high pressure fuel directed to the low pressure drain during an injection event. This partial closing is possible without adversely affecting the movement of nozzle valve element 20 since the cross sectional flow area between valve head 54 and valve seat 57 necessary to create an appropriate pressure drop in control volume 40 sufficient to initiate the outward movement of nozzle valve element 20 is greater than the cross sectional flow area necessary to maintain the pressure level in control volume 40 at a level sufficient to permit continued movement of nozzle valve element 20 and abutment of the outer end of nozzle valve element 20 against valve head 54. In fact, the lifting force of nozzle valve element 20 against control valve member 50 will tend to partially close control valve member 50 while, at the same time, the applied piezo voltage to actuator 52 may be reduced by a predetermined amount as indicated by R in FIG. 3. After a predetermined time period, actuator 52 is de-energized causing contraction of the piezoelectric elements and permitting bias spring 56 to move control valve member 50 into sealing abutment against valve seat 57 as shown in FIG. 2*d*. As a result, the pressure in control volume 40 increases so as to move nozzle valve element 20 to its closed position thus ending injection.

An important feature of the present invention is the ability to monitor the lift of nozzle valve element 20 so as to provide nozzle valve lift information reflective of the injection rate shape and fuel metering quantity. This lift information can then be effectively utilized to adjust the fuel metering and injection rate shape during subsequent injection events by variably controlling the timing and rate of opening of control valve member 50 and thus the timing and rate of opening of nozzle valve element. Thus, the present invention effectively creates a nozzle valve element lift feedback signal to permit more precise control of an injection event.

Figure 5A:
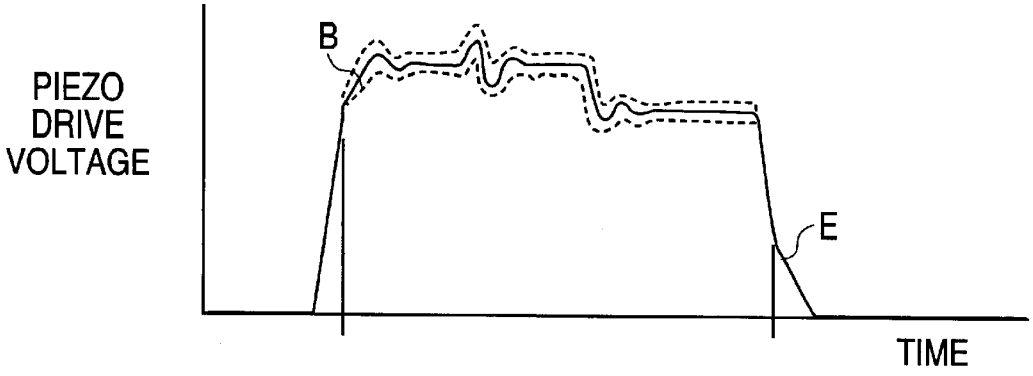
FIGS. 5*a*–5*c* are graphs of piezo drive voltage, control valve and nozzle valve lift, and piezo sensor force versus time showing the sensing of control valve member movement by the control valve member movement detecting device of the present invention.
Figure 5B:
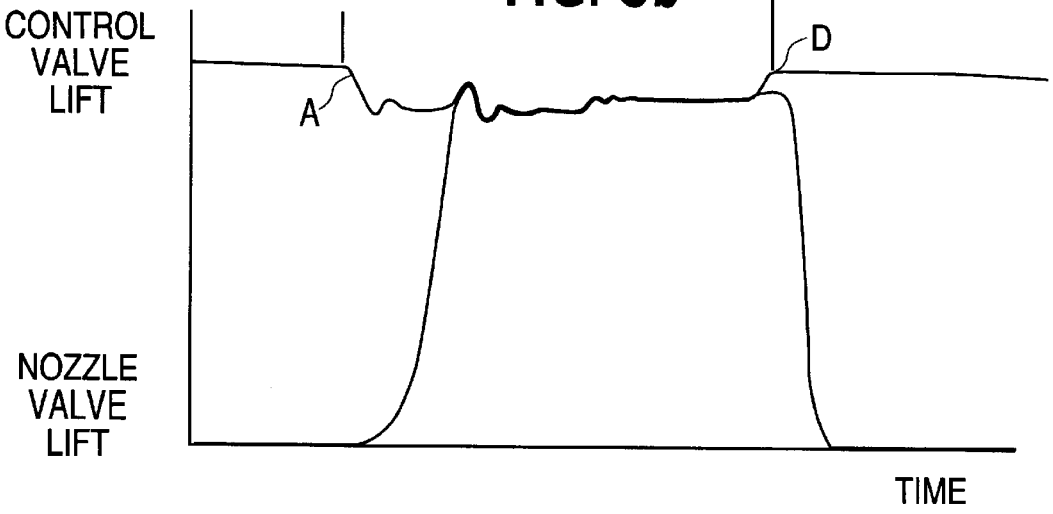
Figure 5C:
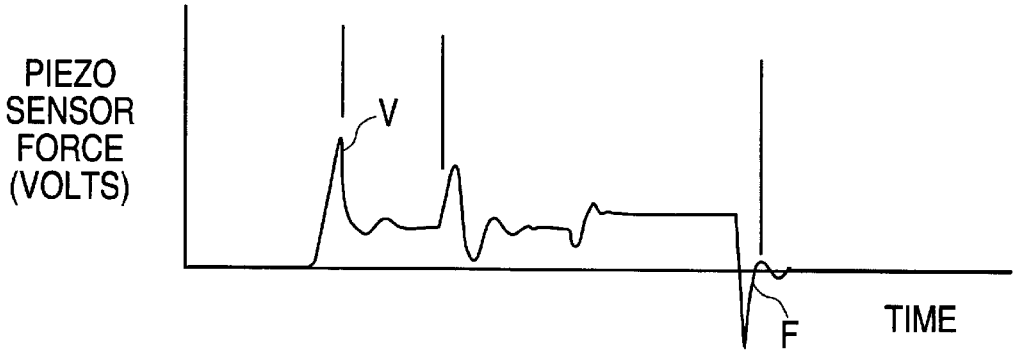

The present invention also includes a control valve member movement detecting device, indicated generally at 70 in FIG. 1, which effectively detects the opening and closing of control valve member 50 and provides a control valve member position feedback signal for optimizing control of the valve. Specifically, in the present embodiment, control valve member movement detecting device 70 includes a portion of, or the entire set of piezoelectric elements of actuator 52 and control device 58. Alternatively, a dedicated force transducer, for example, a set of piezoelectric elements separate from actuator 52, may be used. The portion of the piezoelectric element or the separate force transducer may be connected to control device 58 using separate connections 71. Control device 58 is designed to monitor and detect variations in the piezo voltage in either the entire stack of piezoelectric elements of actuator 52 or alternatively only a portion of the piezoelectric elements of actuator 52. Control valve member movement detecting device 70 actually detects the opening or unseating, and the closing or seating, of control valve member 50 and provides a control valve member position feedback signal for enabling improved control over the movement of control valve member 50 and thus nozzle valve element 20. Specifically, control valve member movement detecting device 70 is adapted to sense the change in voltage in the piezoelectric elements due to a change in the force on the piezoelectric elements resulting from the movement of the control valve off its seat and returning back to its seat. Referring to FIGS. 5*a*–5*c*, during opening of control valve member 50, the drive voltage is applied to actuator 52 causing a buildup in the force between the piezoelectric elements and control valve member 50 until the force overcomes the fuel pressure forces acting on the portion of control valve member 50 exposed to the fuel in control volume 40 when the valve member is in the closed position. When the force applied by the piezoelectric elements against control valve member 50 overcomes the fuel pressure forces tending to close control valve member 50, control valve member unseats or lifts from its seat into an open position as indicated at A in FIG. 5*b*. Almost immediately upon opening, the pressure in control volume 40 drops significantly while, in addition, fuel pressure acts on the opposite side of the valve head thereby decreasing the total fuel pressure induced forces tending to close the valve. This decrease in the force acting against control valve member 50 causes a slight decrease in the load on the piezoelectric elements thereby causing a decrease in the rate of change in the drive voltage as indicated at B in FIG. 5*a* and a decrease in piezo sensor force measured in volts as indicated at V in FIG. 5*c*. This voltage decrease is detected by control device 58. Similarly, when main control valve member 50 moves from the open position into the closed position as indicated at D in FIG. 5*b*, the impact of control valve member 50 against its valve seat causes a change in the reduction rate of the drive voltage as indicated at E in FIG. 5*a* and a slight increase in the piezo sensor force as indicated at F in FIG. 5*c*. Thus, another control valve member position feedback signal is created and then detected by control device 58. Control device 58 may then process and utilize the control valve member position feedback signals in an appropriate manner to vary the timing of the injection control signal and/or the amount of voltage supplied to actuator 52 to thereby variably control the injection timing, fuel metering and/or injection rate shape. It should be noted that the control valve member movement detecting device 70 could be used in combination with other types of injection control valves including a three-way valve.

INDUSTRIAL APPLICABILITY

It is understood that the present invention is applicable to all internal combustion engines utilizing a fuel injection system and to all closed nozzle injectors including unit injectors. This invention is particularly applicable to diesel engines which require accurate fuel injection rate control by a simple rate control device in order to minimize emissions. Such internal combustion engines including a fuel injector in accordance with the present invention can be widely used in all industrial fields, commercial and noncommercial applications, including trucks, passenger cars, industrial equipment, stationary power plants and others.

We claim:

1. A closed nozzle injector for injecting fuel at high pressure into the combustion chamber of an engine, comprising:

an injector body containing an injector cavity and an injector orifice communicating with one end of said injector cavity to discharge fuel into the combustion chamber;

a nozzle valve element positioned in one end of said injector cavity adjacent said injector orifice, said nozzle valve element movable between an open position in which fuel may flow through said injector orifice into the combustion chamber and a closed position in which fuel flow through said injector orifice is blocked;

a control volume positioned to receive a pressurized supply of fuel;

a drain circuit for draining fuel from said control volume to a low pressure drain;

an injection control valve positioned along said drain circuit to control fuel flow from said control volume, said injection control valve including a reciprocally mounted control valve member positioned in said control volume; and nozzle valve element lift detecting means for detecting movement of said nozzle valve element into said open position and for providing a nozzle valve element lift feedback signal.

2. The injector of claim 1, wherein said nozzle valve element lift detecting means includes a piezoelectric element.

3. The injector of claim 1, wherein said control valve member is movable toward an outer end of said nozzle valve element into an open position and away from said nozzle valve element into a closed position, said control valve member positioned for contact by said nozzle valve element.

4. The injector of claim 1, wherein said injection control valve includes a control valve member and said nozzle valve element lift detecting means includes positioning said control valve member for contact by said nozzle valve element when said nozzle valve element is in said open position.

5. The injector of claim 4, wherein said control valve member is of the poppet valve type and said nozzle valve element is a single piece structure.

6. The injector of claim 1, further including a control means for receiving said nozzle valve element lift feedback signal and generating an injection control signal based on said nozzle valve element lift feedback signal.

7. The injector of claim 6, wherein said control means varies said injection control signal based on said nozzle valve element lift feedback signal to vary at least one of a timing of an opening of said injection control valve and a rate of opening of said injection control valve.

8. A closed nozzle injector for injecting fuel at high pressure into the combustion chamber of an engine, comprising:

an injector body containing an injector cavity and an injector orifice communicating with one end of said injector cavity to discharge fuel into the combustion chamber;

a nozzle valve element positioned in one end of said injector cavity adjacent said injector orifice, said nozzle valve element movable between an open position in which fuel may flow through said injector orifice into the combustion chamber and a closed position in which fuel flow through said injector orifice is blocked;

a control volume positioned to receive a pressurized supply of fuel;

a drain circuit for draining fuel from said control volume to a low pressure drain; and an injection control valve positioned along said drain circuit and including a reciprocally mounted control valve member movable toward an outer end of said nozzle valve element into an open position and away from said nozzle valve element into a closed position, said control valve member being positioned for contact by nozzle valve element when said nozzle valve element is in said open position.

9. The injector of claim 8, further including a nozzle valve element lift detecting device adapted to generate a nozzle valve element lift feedback signal based on said contact between said nozzle valve element and said control valve member.

10. The injector of claim 9, wherein said nozzle valve element lift detecting device includes a piezoelectric element, said nozzle valve element feedback signal based on a variation in voltage across said piezoelectric element caused by said contact between said nozzle valve element and said control valve member.

11. The injector of claim 8, wherein said control valve member is of the poppet valve type and said nozzle valve element is a single piece structure.

12. The injector of claim 9, further including a control device adapted to receive said nozzle valve element lift feedback signal and generate an injection control signal based on said nozzle valve element lift feedback signal.

13. The injector of claim 12, wherein said control device is adapted to vary said injection control signal based on said nozzle valve element lift feedback signal to vary at least one of a timing of an opening of said injection control valve and a rate of opening of said injection control valve.

14. A closed nozzle injector for injecting fuel at high pressure into the combustion chamber of an engine, comprising:

an injector body containing an injector cavity and an injector orifice communicating with one end of said injector cavity to discharge fuel into the combustion chamber, said injector body including a fuel transfer circuit for transferring supply fuel to said injector orifice;

a nozzle valve element positioned in one end of said injector cavity adjacent said injector orifice, said nozzle valve element movable between an open position in which fuel may flow from said fuel transfer circuit through said injector orifice into the combustion chamber and a closed position in which fuel flow through said injector orifice is blocked, movement of said nozzle valve element from said closed position to said open position and from said open position to said closed position defining an injection event during which fuel may flow through said injector orifice into the combustion chamber;

a nozzle valve control means for moving said nozzle valve element between said open and said closed positions, said nozzle valve control means including a control volume positioned adjacent an outer end of said nozzle valve element, a control volume charge circuit for supplying fuel from said fuel transfer circuit to said control volume, a drain circuit for draining fuel from said control volume to a low pressure drain, and an injection control valve positioned along said drain circuit and operable to control the flow of fuel through said drain circuit, wherein said nozzle valve element is positioned to contact said injection control valve to define an outermost open position of said nozzle valve element.

15. The injector of claim 14, wherein said injection control valve includes a reciprocally mounted control valve member and an actuator for selectively moving said control valve member relative to said nozzle valve element, said actuator capable of moving said control valve member at a predetermined variable rate to vary an opening rate of said nozzle valve element.

16. The injector of claim 15, further including a nozzle valve element lift detecting device adapted to generate a nozzle valve element lift feedback signal based on said contact between said nozzle valve element and said control valve member.

17. The injector of claim 16, wherein said nozzle valve element lift detecting device includes a piezoelectric element, said nozzle valve element feedback signal based on a variation in voltage across said piezoelectric element caused by said contact between said nozzle valve element and said control valve member.

18. The injector of claim 16, further including a control device adapted to receive said nozzle valve element lift feedback signal and to generate an injection control signal based on said nozzle valve element lift feedback signal.

19. The injector of claim 18, wherein said control device is adapted to vary said injection control signal based on said nozzle valve element lift feedback signal to vary at least one of a timing of an opening of said injection control valve and a rate of opening of said injection control valve.

20. A closed nozzle injector for injecting fuel at high pressure into the combustion chamber of an engine, comprising:

an injector body containing an injector cavity and an injector orifice communicating with one end of said injector cavity to discharge fuel into the combustion chamber;

a nozzle valve element positioned in one end of said injector cavity adjacent said injector orifice, said nozzle valve element movable between an open position in which fuel may flow through said injector orifice into the combustion chamber and a closed position in which fuel flow through said injector orifice is blocked;

a control volume positioned to receive a pressurized supply of fuel;

a drain circuit for draining fuel from said control volume to a low pressure drain;

an injection control valve positioned along said drain circuit to control fuel flow from said control volume, said injection control valve including a reciprocally mounted control valve member movable between open and closed positions; and control valve member movement detecting means for detecting movement of said control valve member into at least one of said open and said closed positions and for providing a control valve member position feedback signal, wherein said injection control valve further includes a piezoelectric actuator including piezoelectric elements adapted to cause movement of said control valve member between open and closed positions, said control valve member movement detecting means including at least a portion of said piezoelectric elements.

21. The injector of claim 20, wherein said control valve member is movable toward an outer end of said nozzle valve element into said open position and away from said nozzle valve element into said closed position, said control valve member positioned for contact by said nozzle valve element.

22. The injector of claim 20, further including a control means for receiving said control valve member position feedback signal and generating an injection control signal based on said control valve member position feedback signal.

* * * * *